US010392680B2

(12) United States Patent
Maki et al.

(10) Patent No.: US 10,392,680 B2
(45) Date of Patent: Aug. 27, 2019

(54) COPPER ALLOY FOR ELECTRIC AND ELECTRONIC DEVICES, COPPER ALLOY SHEET FOR ELECTRIC AND ELECTRONIC DEVICES, COMPONENT FOR ELECTRIC AND ELECTRONIC DEVICES, TERMINAL, AND BUS BAR

(71) Applicant: MITSUBISHI MATERIALS CORPORATION, Tokyo (JP)

(72) Inventors: Kazunari Maki, Saitama (JP); Hirotaka Matsunaga, Okegawa (JP); Shuhei Arisawa, Aizuwakamatsu (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 267 days.

(21) Appl. No.: 14/911,384

(22) PCT Filed: Jul. 17, 2014

(86) PCT No.: PCT/JP2014/069043
§ 371 (c)(1),
(2) Date: Feb. 10, 2016

(87) PCT Pub. No.: WO2015/022837
PCT Pub. Date: Feb. 19, 2015

(65) Prior Publication Data

US 2016/0186294 A1 Jun. 30, 2016

(30) Foreign Application Priority Data

Aug. 12, 2013 (JP) ..... 2013-167829

(51) Int. Cl.

| | |
|---|---|
| ***C22C 9/02*** | (2006.01) |
| ***H01B 1/02*** | (2006.01) |
| ***H01R 13/03*** | (2006.01) |
| ***C22C 9/00*** | (2006.01) |
| ***C22F 1/08*** | (2006.01) |

(52) U.S. Cl.
CPC ..... *C22C 9/02* (2013.01); *C22C 9/00* (2013.01); *C22F 1/08* (2013.01); *H01B 1/026* (2013.01); *H01R 13/03* (2013.01)

(58) Field of Classification Search
CPC .... C22C 9/00; C22C 9/02; C22F 1/08; H01B 1/026; H01R 13/03
USPC ..... 420/492, 490
See application file for complete search history.

(56) References Cited

U.S. PATENT DOCUMENTS

| | | | | | |
|---|---|---|---|---|---|
| 4,451,430 | A * | 5/1984 | Matidori | H01B 1/026 | 420/492 |
| 5,705,125 | A * | 1/1998 | Goto | C22C 9/00 | 420/470 |
| 6,312,762 | B1 * | 11/2001 | Sugawara | C22F 1/02 | 148/276 |
| 2013/0056116 | A1 * | 3/2013 | Ito | C22C 9/00 | 148/684 |
| 2014/0193655 | A1 * | 7/2014 | Kurosaki | C22C 9/00 | 428/544 |

FOREIGN PATENT DOCUMENTS

| | | | | | |
|---|---|---|---|---|---|
| EP | 2752498 | A | | 7/2014 | |
| JP | 52-003524 | A | | 1/1977 | |
| JP | 52003524 | A | * | 1/1977 | |
| JP | 60-124960 | A | | 7/1985 | |
| JP | 63-130737 | A | | 6/1988 | |
| JP | 01208431 | A | * | 8/1989 | B22D 11/059 |
| JP | 03-126830 | A | | 5/1991 | |
| JP | 03226241 | A | * | 10/1991 | |
| JP | 04-006233 | A | | 1/1992 | |
| JP | 05-311284 | A | | 11/1993 | |
| JP | 06-279895 | A | | 10/1994 | |
| JP | 06-346206 | A | | 12/1994 | |
| JP | 07-258775 | A | | 10/1995 | |
| JP | 07-258776 | A | | 10/1995 | |
| JP | 07-258804 | A | | 10/1995 | |
| JP | 08-157985 | A | | 6/1996 | |
| JP | 08157985 | A | * | 6/1996 | |
| JP | 2002-025353 | A | | 1/2002 | |
| JP | 3348470 | B | | 11/2002 | |
| JP | 2003089832 | A | * | 3/2003 | C22C 9/00 |
| JP | 2004-149874 | A | | 5/2004 | |
| JP | 2005-097639 | A | | 4/2005 | |
| JP | 2005-113180 | A | | 4/2005 | |
| JP | 2005-288519 | A | | 10/2005 | |
| JP | 2008-223106 | A | | 9/2008 | |
| JP | 2010-248592 | A | | 11/2010 | |
| JP | 2012-062498 | A | | 3/2012 | |
| JP | 2012-062499 | A | | 3/2012 | |
| JP | 2012-097308 | A | | 5/2012 | |
| JP | 2013-007062 | A | | 1/2013 | |
| JP | 2013-104110 | A | | 5/2013 | |
| JP | 2013-129889 | A | | 7/2013 | |
| JP | 2013-199699 | A | | 10/2013 | |
| JP | 5307305 | B | | 10/2013 | |
| TW | 200702458 | A | | 1/2007 | |
| WO | WO-2011142428 | A1 | * | 11/2011 | C22C 9/00 |
| WO | WO-2012132713 | A1 | * | 10/2012 | C22C 9/00 |
| WO | WO-2013/031841 | A | | 3/2013 | |
| WO | WO-2013031841 | A1 | * | 3/2013 | C22F 1/00 |

OTHER PUBLICATIONS

Nomura, "Technical Trends in High Performance Copper Alloy Strip for Connector and Kobe Steel's Development Strategy", *Kobe Steel Engineering Reports,* 2004, pp. 2-8, vol. 54, No. 1.

(Continued)

*Primary Examiner* — Jenny R Wu
(74) *Attorney, Agent, or Firm* — Leason Ellis LLP

(57) ABSTRACT

Provided are a copper alloy for electric and electronic devices, a copper alloy sheet for electric and electronic devices, a component for electric and electronic devices, a terminal, and a bus bar. The copper alloy for electric and electronic devices includes, as a composition: 0.01 mass % or higher and lower than 0.11 mass % of Zr; 0.002 mass % or higher and lower than 0.03 mass % of Si; and a balance including Cu and unavoidable impurities, in which a ratio Zr/Si of the Zr content (mass %) to the Si content (mass %) is within a range of 2 to 30.

10 Claims, 3 Drawing Sheets

(56) References Cited

OTHER PUBLICATIONS

Internal Search Report dated Sep. 9, 2014 for the corresponding PCT Application No. PCT/JP2014/069043.
Notice of Allowance dated Nov. 18, 2014 for the corresponding Japanese Application No. 2013-167829.
Office Action dated May 18, 2015 for the corresponding Taiwanese Application No. 103124528.
Dong Zhili et al. "Structure and Properties of Age Hardening Copper-Zirconium-Silicon Alloys" *Mechanical Engineering Material,* Apr. 1991, pp. 40-42, No. 4.
Office Action dated Oct. 28, 2016 for the corresponding Chinese Patent Application No. 201480045246.9.
Extended European Search Report dated Apr. 6, 2017 for the corresponding European Patent Application No. 14836920.0.

* cited by examiner

COPPER ALLOY FOR ELECTRIC AND ELECTRONIC DEVICES, COPPER ALLOY SHEET FOR ELECTRIC AND ELECTRONIC DEVICES, COMPONENT FOR ELECTRIC AND ELECTRONIC DEVICES, TERMINAL, AND BUS BAR

CROSS-REFERENCE TO RELATED PATENT APPLICATIONS

This application is a U.S. National Phase Application under 35 U.S.C. § 371 of International Patent Application No. PCT/JP2014/069043, filed Jul. 17, 2014, and claims the benefit of Japanese Patent Application No. 2013-167829, filed Aug. 12, 2013, all of which are incorporated by reference in their entireties herein. The International Application was published in Japanese on Feb. 19, 2015 as International Publication No. WO/2015/022837 under PCT Article 21(2).

FIELD OF THE INVENTION

The present invention relates to a copper alloy for electric and electronic devices and a copper alloy sheet for electric and electronic devices, a component for electric and electronic devices, a terminal, and a bus bar using the same, the copper alloy being used as a component for electric and electronic devices such as a connector of a semiconductor device, other terminals thereof, a movable contact of an electromagnetic relay, a lead frame, or a bus bar.

BACKGROUND OF THE INVENTION

Recently, along with reductions in the size and weight of electric and electronic devices, an attempt has been made to reduce the size and thickness of a component for electric and electronic devices such as a terminal (for example, a connector), a relay, a lead frame, or a bus bar used for the electric and electronic devices. Therefore, as a material constituting the component for electric and electronic devices, a copper alloy having superior spring properties, strength, and bendability is required. In particular, as described in Non-Patent Document 1, high yield strength is desired for a copper alloy used for a component for electric and electronic devices such as a terminal (for example, a connector), a relay, a lead frame, or a bus bar.

In particular, in an application in which high electrical conductivity is required, CDA Alloy No. 15100 (Cu—Zr-based alloy) is used. In addition, Patent Documents 1 to 3 disclose a copper alloy containing the above-described Cu—Zr-based alloy as a base in which properties are further improved.

The Cu—Zr-based alloy is a precipitation-hardened copper alloy in which the strength is improved while the high electrical conductivity is maintained, and in which heat resistance is superior.

CITATION LIST

Patent Document

[Patent Document 1] Japanese Unexamined Patent Application, First Publication No. S52-003524

[Patent Document 2] Japanese Unexamined Patent Application, First Publication No. S63-130737

[Patent Document 3] Japanese Unexamined Patent Application, First Publication No. H6-279895

Non-Patent Document

[Non-Patent Document 1] Koya NOMURA, "Technological Trends in High Performance Copper Alloy Strip for Connector and Kobe Steel's Development Strategy", Kobe Steel Engineering Reports, Vol. 54, No. 1(2004), p. 2-8

TECHNICAL PROBLEM

However, a component for electric and electronic devices such as a terminal (for example, a connector), a relay, a lead frame, or a bus bar is manufactured, for example, by press-punching a plate material of a copper alloy and, optionally, further bending the punched plate material. Therefore, the above-described copper alloy is required to have superior shearing performance such that wearing or burr formation on a press mold can be limited during press punching or the like.

Here, the above-described Cu—Zr-based alloy has a composition close to pure copper in order to secure high electrical conductivity in which ductility is high and shearing performance is poor. Specifically, during press punching, there are problems in that burrs are formed and punching cannot be performed with high dimensional accuracy. Further, there are also problems in that a press mold is likely to be worn in that a large amount of punching scraps are formed.

Recently, along with further reductions in the size and weight of electric and electronic devices, further reductions in the size and thickness of a component for electric and electronic devices such as a terminal (for example, a connector), a relay, a lead frame, or a bus bar used for the electric and electronic devices has been required. Therefore, from the viewpoint of forming a component for electric and electronic devices with high dimensional accuracy, a copper alloy with sufficiently improved shearing performance is required as a material constituting the component for electric and electronic devices.

Here, when the Vickers hardness of a copper alloy is improved, the shearing performance is improved. Further, when the Vickers hardness of a copper alloy is improved, the surface scratch resistance (wear resistance) is improved. Therefore, for the copper alloy used for the component for electric and electronic devices, the above-described Vickers hardness is required to be high.

In addition, for the terminal such as a connector, severe bending is necessary in order to secure a contact pressure, which requires higher yield strength than in the related art.

Further, in a component for electric and electronic devices having high electric power consumption which is used in a hybrid vehicle, an electric vehicle, or the like, it is necessary that high electrical conductivity is secured in order to suppress the generation of resistance heat during electric current application.

The present invention has been made in consideration of the above-described circumstances, and an object thereof is to provide a copper alloy for electric and electronic devices formed of a Cu—Zr-based alloy, and a copper alloy sheet for electric and electronic devices, a component for electric and electronic devices, a terminal, and a bus bar which are formed of the copper alloy for electric and electronic devices, the Cu—Zr-based alloy having high electrical conductivity, high yield strength, and a high Vickers hardness and being suitable for use in a component for electric and electronic devices such as a terminal (for example, a connector), a relay, or a bus bar.

SUMMARY OF THE INVENTION

Solution to Problem

As a result of a thorough study for solving the above-described problems, the present inventors found that the electrical conductivity and yield strength can be improved and the Vickers hardness can be significantly improved by adding a small amount of Si to a Cu—Zr-based alloy and adjusting the mass ratio Zr/Si.

The present invention has been made in consideration of the above-described findings. According to the present invention, there is provided a copper alloy for electric and electronic devices, the copper alloy including, as a composition: 0.01 mass % or higher and lower than 0.11 mass % of Zr; 0.002 mass % or higher and lower than 0.03 mass % of Si; and a balance including Cu and unavoidable impurities, in which a ratio Zr/Si of the Zr content (mass %) to the Si content (mass %) is within a range of 2 to 30.

The copper alloy for electric and electronic devices having the above-described configuration contains Zr and Si in the above-described range. Therefore, due to precipitation hardening, the yield strength can be improved while maintaining high electrical conductivity. Alternatively, the electrical conductivity can be further improved while maintaining high yield strength. In addition, by precipitate particles being dispersed in the matrix of copper, the Vickers hardness can be improved.

In addition, the ratio Zr/Si of the Zr content (mass %) to the Si content (mass %) is within a range of 2 to 30. Therefore, excess amounts of Si and Zr are not present, and a decrease in the electrical conductivity caused by a solid solution of Si and Zr in the matrix of copper can be limited.

Here, it is preferable that the copper alloy for electric and electronic devices according to the present invention includes Cu—Zr—Si particles containing Cu, Zr, and Si.

As the Cu—Zr—Si particles containing Cu, Zr, and Si, coarse particles having a particle size of 1 μm to 50 μm, which are crystallized or segregated during melting and casting, and fine particles having a particle size of 1 nm to 500 nm, which are precipitated during the subsequent heat treatment or the like, are present.

The relatively coarse Cu—Zr—Si particles having a particle size of 1 μm to 50 μm do not contribute to the improvement of the strength but can significantly improve the shearing performance by functioning as a fracture origin when shearing represented by press punching is performed.

On the other hand, the fine Cu—Zr—Si particles having a particle size of 1 nm to 500 nm contribute to the improvement of the strength and can improve the yield strength while maintaining high electrical conductivity. Alternatively, the electrical conductivity can be further improved while maintaining high yield strength. In addition, by the Vickers hardness being improved, a structure having a high dislocation density is formed in the matrix and is easily fractured during shearing. Therefore, the size of sags and burrs can be limited, and shearing performance is improved.

In addition, in the copper alloy for electric and electronic devices according to the present invention, it is preferable that at least a part of the Cu—Zr—Si particles have a particle size of 1 nm to 500 nm.

As described above, the fine Cu—Zr—Si particles having a particle size of 1 nm to 500 nm significantly contribute to the improvement of the strength. Therefore, the yield strength can be improved while maintaining high electrical conductivity. Alternatively, the electrical conductivity can be further improved while maintaining high yield strength.

In addition, the copper alloy for electric and electronic devices according to the embodiment may further include 0.005 mass % to 0.1 mass % in total of one element, or two or more elements selected from the group consisting of Ag, Sn, Al, Ni, Zn, and Mg.

In this case, the yield strength can be further improved by these elements forming a solid solution in the matrix of copper. Since the amount of the elements is 0.1 mass % or lower, high electrical conductivity can be maintained.

In addition, the copper alloy for electric and electronic devices according to the present invention may further include 0.005 mass % to 0.1 mass % in total of one element or two or more elements selected from the group consisting of Ti, Co, and Cr.

In this case, these elements are precipitated alone or as a compound. As a result, the yield strength can be further improved without a decrease in the electrical conductivity.

In addition, the copper alloy for electric and electronic devices according to the present invention may further include 0.005 mass % to 0.1 mass % in total of one element or two or more elements selected from the group consisting of P, Ca, Te, and B.

In this case, these elements constitute coarse particles through crystallization and segregation during melting and casting and are dispersed in the matrix of copper. The relatively coarse particles can significantly improve the shearing performance by functioning as a fracture origin when shearing represented by press punching is performed.

In addition, in the copper alloy for electric and electronic devices according to the present invention, it is preferable that electrical conductivity is 80% IACS or higher.

In this case, by precipitate particles being sufficiently dispersed in the matrix, the yield strength can be reliably improved. In addition, the copper alloy for electric and electronic devices according to the embodiment can be used as a material of a component for electric and electronic devices in which particularly high electrical conductivity is required.

Further, it is preferable that the copper alloy for electric and electronic devices according to the present invention has mechanical characteristics in which the 0.2% yield strength is 300 MPa or higher.

When the 0.2% yield strength is 300 MPa or higher, the copper alloy is not likely to be plastically deformed and thus is particularly suitable for a component for electric and electronic devices such as a terminal (for example, a connector), a relay, a lead frame, or a bus bar.

Further, it is preferable that the copper alloy for electric and electronic devices according to the present invention has a Vickers hardness of 100 HV or higher.

By adjusting the Vickers hardness to be 100 HV or higher, a structure having a high dislocation density is more reliably formed in the matrix and is easily fractured during shearing. Therefore, the size of sags and burrs can be limited, and shearing performance is improved.

According to the present invention, there is provided a copper alloy sheet for electric and electronic devices, the copper alloy sheet including a rolled material of the above-described copper alloy for electric and electronic devices, in which a thickness is within a range of 0.05 mm to 1.0 mm.

The copper alloy sheet for electric and electronic devices having the above-described configuration can be suitably used as a material of a connector, other terminals, a movable contact of an electromagnetic relay, a lead frame, or a bus bar.

Here, in the copper alloy sheet for electric and electronic devices according to the present invention, a surface may be plated with Sn or Ag.

According to the present invention, there is provided a component for electric and electronic devices including the above-described copper alloy for electric and electronic devices. Examples of the component for electric and electronic devices according to the present invention include a terminal (for example, a connector), a relay, a lead frame, and a bus bar.

According to the present invention, there is provided a terminal including the above-described copper alloy for electric and electronic devices. Examples of the terminal according to the present invention include a connector.

Further, according to the present invention, there is provided a bus bar including the above-described copper alloy for electric and electronic devices.

The component for electric and electronic devices having the above-described configuration (for example, a terminal (for example, a connector), a relay, a lead frame, or a bus bar), in particular, the terminal (for example, a connector) and the bus bar have high electrical conductivity, high yield strength, and high Vickers hardness. Therefore, the dimensional accuracy is superior, and superior characteristics can be exhibited even when the size and thickness are reduced.

Advantageous Effects of Invention

According to the present invention, it is possible to provide a copper alloy for electric and electronic devices formed of a Cu—Zr-based alloy, and a copper alloy sheet for electric and electronic devices, a component for electric and electronic devices, a terminal, and a bus bar which are formed of the copper alloy for electric and electronic devices, the Cu—Zr-based alloy having high electrical conductivity, high yield strength, and high Vickers hardness and being suitable for a component for electric and electronic devices such as a terminal (for example, a connector), a relay, or a bus bar.

DETAILED DESCRIPTION OF THE INVENTION

Figure 1:
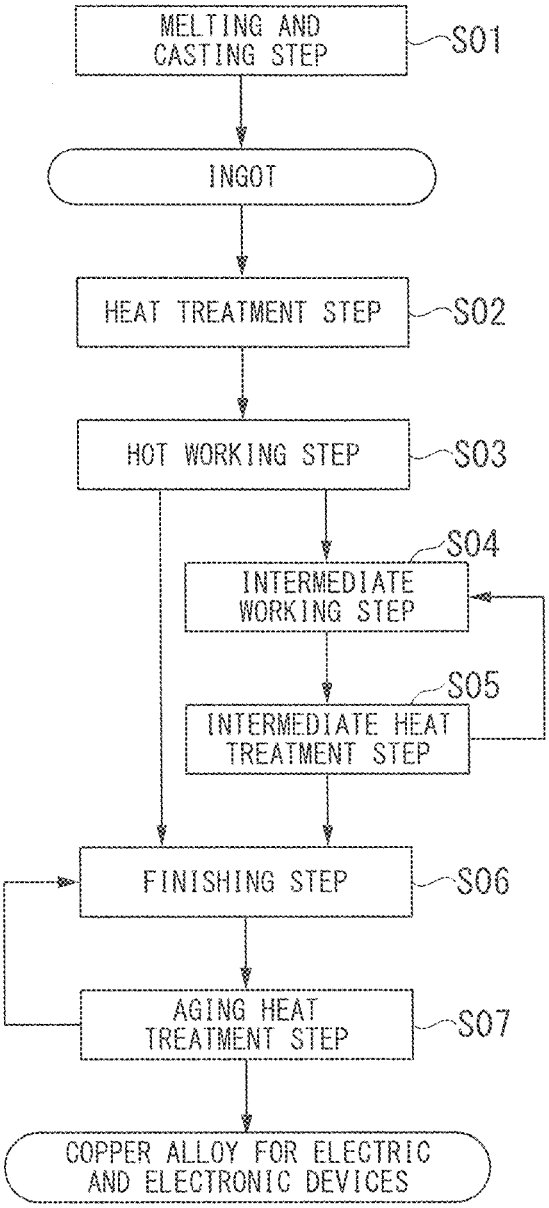
FIG. 1 is a flow chart showing a process example of a copper alloy for electric and electronic devices according to an embodiment of the present invention.

Hereinafter, a copper alloy for electric and electronic devices according to an embodiment of the present invention will be described.

The copper alloy for electric and electronic devices according to the embodiment includes, as a composition: 0.01 mass % or higher and lower than 0.11 mass % of Zr; 0.002 mass % or higher and lower than 0.03 mass % of Si; and a balance including Cu and unavoidable impurities, in which a ratio Zr/Si of the Zr content (mass %) to the Si content (mass %) is within a range of 2 to 30.

The copper alloy for electric and electronic devices according to the embodiment may further include 0.005 mass % to 0.1 mass % in total of one element or two or more elements selected from the group consisting of Ag, Sn, Al, Ni, Zn, and Mg.

In addition, the copper alloy for electric and electronic devices according to the embodiment may further include 0.005 mass % to 0.1 mass % in total of one element or two or more elements selected from the group consisting of Ti, Co, and Cr.

Further, the copper alloy for electric and electronic devices according to the embodiment may further include 0.005 mass % to 0.1 mass % in total of one element or two or more elements selected from the group consisting of P, Ca, Te, and B.

The copper alloy for electric and electronic devices according to the embodiment includes Cu—Zr—Si particles containing Cu, Zr, and Si. As the Cu—Zr—Si particles, relatively coarse particles having a particle size of 1 μm to 50 μm and fine particles having a particle size of 1 nm to 500 nm are present.

In the copper alloy for electric and electronic devices, electrical conductivity is 80% IACS or higher, 0.2% yield strength is 300 MPa or higher, and surface Vickers hardness is 100 HV or higher.

The upper limit value of the 0.2% yield strength is not particularly limited but can be set to 750 MPa. In addition, the upper limit value of the surface Vickers hardness is not particularly limited and can be set to be 250 HV.

Hereinafter, the reason for specifying the component composition, the structure, and the like as described above will be described below.

(Zr)

Zr is an element that constitutes the above-described Cu—Zr—Si particle and has an effect of improving the yield strength while maintaining the electrical conductivity or an effect of improving the electrical conductivity while maintaining the yield strength. In addition, the Vickers hardness can be improved.

Here, when the Zr content is lower than 0.01 mass %, the effects cannot be sufficiently exhibited. On the other hand, when the Zr content is 0.11 mass % or higher, the electrical conductivity may significantly decrease, and solutionization is difficult to perform, which may cause defects such as disconnection or cracking during hot working or cold working.

From these points of view, in the embodiment, the Zr content is set to be within a range of 0.01 mass % or higher and lower than 0.11 mass %. In order to secure the number of Cu—Zr—Si particles to reliably improve the strength, the Zr content is preferably 0.04 mass % or higher, and is more preferably 0.05 mass % or higher. In addition, in order to reliably suppress, for example, an increase in the electrical conductivity and defects during working, the Zr content is preferably 0.10 mass % or lower.

(Si)

Si is an element that constitutes the above-described Cu—Zr—Si particle and has an effect of improving the yield strength while maintaining the electrical conductivity or an effect of improving the electrical conductivity while maintaining the yield strength. In addition, the Vickers hardness can be improved.

Here, when the Si content is lower than 0.002 mass %, the effects cannot be sufficiently exhibited. On the other hand, when the Si content is 0.03 mass % or higher, the electrical conductivity may significantly decrease.

From these points of view, in the embodiment, the Si content is set to be within a range of 0.002 mass % or higher and lower than 0.03 mass %. In order to secure the number of Cu—Zr—Si particles to reliably improve the strength, the Si content is preferably 0.003 mass % or higher, and is more preferably 0.004 mass % or higher. In addition, in order to reliably suppress an increase in the electrical conductivity, the Si content is preferably 0.025 mass % or lower, and is more preferably 0.02 mass % or lower.

(Zr/Si)

As described above, the Cu—Zr—Si particles are formed by adding Zr and Si to Cu. As a result, the yield strength can be improved while maintaining the electrical conductivity, or the electrical conductivity can be improved while maintaining the yield strength. In addition, the Vickers hardness can be improved.

Here, when the ratio Zr/Si of the Zr content (mass %) to the Si content (mass %) is lower than 2, the Si content is higher than the Zr content. Therefore, the electrical conductivity may decrease due to an excess amount of Si. On the other hand, when Zr/Si is higher than 30, the Si content is lower than the Zr content. Therefore, the Cu—Zr—Si particles cannot be sufficiently formed, and the above-described effects cannot be sufficiently exhibited.

From these points of view, in the embodiment, the ratio Zr/Si of the Zr content (mass %) to a Si content (mass %) is within a range of 2 to 30. In order to reliably suppress a decrease in the electrical conductivity, it is preferable that Zr/Si is set to be 3 or higher. In addition, in order to secure the number of Cu—Zr—Si particles to reliably improve the strength, Zr/Si is preferably 25 or lower, and is more preferably 20 or lower.

(Ag, Sn, Al, Ni, Zn, Mg)

Ag, Sn, Al, Ni, Zn, or Mg has an effect of forming a solid solution in the matrix of copper to improve the strength. Accordingly, in order to realize further improvement in the strength, it is preferable that the above elements are appropriately added.

Here, when the total content of one element or two or more elements selected from the group consisting of Ag, Sn, Al, Ni, Zn, and Mg is lower than 0.005 mass %, the above-described effect may not be reliably exhibited. On the other hand, when the total amount of one element or two or more elements selected from the group consisting of Ag, Sn, Al, Ni, Zn, and Mg is higher than 0.1 mass %, the electrical conductivity may significantly decrease.

From these points of view, in order to realize further improvement in the strength through the addition of Ag, Sn, Al, Ni, Zn, or Mg, it is preferable that the total content of one element or two or more elements selected from the group consisting of Ag, Sn, Al, Ni, Zn, and Mg is within a range of 0.005 mass % to 0.1 mass %.

(Ti, Co, Cr)

Ti, Co, or Cr constitute precipitate particles and has an effect of significantly improving the strength while maintaining the electrical conductivity. Accordingly, in order to realize further improvement in the strength, it is preferable that the above elements are appropriately added.

Here, when the total amount of one element or two or more elements selected from the group consisting of Ti, Co, and Cr is lower than 0.005 mass %, the above-described effect may not be reliably exhibited. On the other hand, when the total content of one element or two or more elements selected from the group consisting of Ti, Co, and Cr is higher than 0.1 mass %, the electrical conductivity may decrease.

From these points of view, in order to realize further improvement in the strength through the addition of Ti, Co, or Cr, it is preferable that the total content of one element or two or more elements selected from the group consisting of Ti, Co, and Cr is within a range of 0.005 mass % to 0.1 mass %.

(P, Ca, Te, B)

P, Ca, Te, or B constitutes relatively coarse particles through crystallization and segregation during melting and casting and has an effect of significantly improving the shearing performance. Accordingly, in order to further improve the shearing performance, it is preferable that the above elements are appropriately added.

Here, when the total content of one element or two or more elements selected from the group consisting of P, Ca, Te, and B is lower than 0.005 mass %, the above-described effect may not be reliably exhibited. On the other hand, when the total content of one element or two or more elements selected from the group consisting of P, Ca, Te, and B is higher than 0.1 mass %, the electrical conductivity may decrease.

From these points of view, in order to realize further improvement in the shearing performance through the addition of P, Ca, Te, or B, it is preferable that the total content of one element or two or more elements selected from the group consisting of P, Ca, Te, and B is within a range of 0.005 mass % to 0.1 mass %.

(Unavoidable Impurities)

Examples of the unavoidable impurities other than the above-described elements include Fe, Mn, Sr, Ba, Sc, Y, Hf, V, Nb, Ta, Mo, W, Re, Ru, Os, Se, Rh, Ir, Pd, Pt, Au, Cd, Ga, In, Li, Ge, As, Sb, Tl, Pb, C, Be, N, H, Hg, Tc, Na, K, Rb, Cs, O, S, Po, Bi, and lanthanoid elements. It is preferable that the total amount of these unavoidable impurities is preferably 0.3 mass % or lower.

(Cu—Zr—Si Particles)

When Zr and Si are added to Cu, Cu—Zr—Si particles containing Cu, Zr, and Si are present. In the embodiment, as described above, as the Cu—Zr—Si particles, relatively coarse particles having a particle size of 1 μm to 50 μm and fine particles having a particle size of 1 nm to 500 nm are present.

Here, it is presumed that the coarse Cu—Zr—Si particles having a particle size of 1 μm to 50 μm are crystallized or segregated during melting and casting. In addition, it is presumed that the fine Cu—Zr—Si particles having a particle size of 1 nm to 500 nm are precipitated during a subsequent heat treatment or the like.

The coarse Cu—Zr—Si particles having a particle size of 1 μm to 50 μm do not contribute to the improvement of the strength but can significantly improve the shearing performance by functioning as a fracture origin when shearing represented by press punching is performed.

On the other hand, the fine Cu—Zr—Si particles having a particle size of 1 nm to 500 nm contribute to the improvement of the strength and can improve the yield strength while maintaining high electrical conductivity. Alternatively, the electrical conductivity can be further improved while maintaining high yield strength. In addition, the Vickers hardness can be improved.

(Electrical Conductivity: 80% IACS or Higher)

When Zr and Si form a solid solution in the matrix of Cu, the electrical conductivity significantly decreases. Therefore, in the embodiment, the electrical conductivity is defined to be 80% IACS or higher. Thus, the above-described Cu—Zr—Si particles are sufficiently present, and the strength and the shearing performance can be reliably improved.

In order to reliably exhibit the above-described effects, the electrical conductivity is preferably 85% IACS or higher, and is more preferably 88% IACS or higher. In addition, the upper limit value of the electrical conductivity of the copper alloy for electric and electronic devices according to the embodiment is not particularly limited but may be lower than 100% IACS.

Next, a method of manufacturing the copper alloy for electric and electronic devices according to the embodiment having the above-described configuration will be described with reference to a flow chart shown in FIG. 1.

(Melting and Casting Step S01)

First, Zr and Si are added to molten copper obtained by melting a copper raw material to adjust the components. As a result, molten copper alloy is prepared. During the addition of Zr and Si, for example, elemental Zr, elemental Si, a Cu—Zr master alloy, or a Cu—Si master alloy can be used. In addition, a raw material containing Zr and Si may be melted together with a copper raw material. In addition, a recycled material or a scrap material of the alloy may be used. When an element other than Zr and Si (for example, Ag, Sn, Al, Ni, Zn, Mg, Ti, Co, Cr, P, Ca, Te, or B) is added, various raw materials can be used as described above.

It is preferable that the molten copper is a so-called 4NCu having a purity of 99.99 mass % or higher. In addition, during the preparation of the molten copper alloy, it is preferable that a vacuum furnace or a furnace in an atmosphere such as an inert gas atmosphere, or a reducing atmosphere is used in order to suppress, for example, oxidation of Zr and Si.

The molten copper alloy whose components are adjusted is poured into a casting mold to prepare an ingot. In consideration of mass production, it is preferable that a continuous casting method or a semi-continuous casting method is used.

(Heat Treatment Step S02)

Next, a heat treatment is performed for the homogenization and solutionization of the obtained ingot. By performing a heat treatment of heating the ingot at 800° C. to 1080° C., Zr and Si are homogeneously dispersed in the ingot and form a solid solution in the matrix. It is preferable that the heat treatment step S02 is performed in a non-oxidizing or reducing atmosphere.

A cooling method after heating is not particularly limited, but a method such as water quenching in which the cooling rate is 200° C./min or higher is preferably adopted.

(Hot Working Step S03)

Next, hot working is performed for the optimization of rough processing and the homogenization of the structure. A working method is not particularly limited. However, when it is desired that the final shape is a sheet or a strip, rolling is preferably adopted. When it is desired that the final shape is a wire or a rod, extrusion or groove rolling is preferably adopted. When it is desired that the final shape is a bulk shape, forging or pressing is preferably adopted. The temperature during the hot working is not particularly limited but is preferably within a range of 500° C. to 1050° C.

A cooling method after the hot working is not particularly limited, but a method such as water quenching in which the cooling rate is 200° C./min or higher is preferably adopted.

(Intermediate Working Step S04/Intermediate Heat Treatment Step S05)

In addition, after the hot working, intermediate working and an intermediate heat treatment may be performed for softening in order to strictly perform solutionization or to recrystallize the structure, or to improve workability. Temperature conditions in the intermediate working step S04 are not particularly limited but are preferably within a range of −200° C. to 200° C. in which cold working is performed. In addition, a working ratio in the intermediate working step S04 is appropriately selected so as to obtain a shape close to the final shape. In order to reduce the number of times of the intermediate heat treatment step S05 until the final shape is obtained, the working ratio is preferably 20% or higher. In addition, the working ratio is more preferably 30% or higher. A plastic working method is not particularly limited. For example, rolling, wire drawing, extrusion, groove rolling, forging, or pressing can be adopted.

A heat treatment method in the intermediate heat treatment step S05 is not particularly limited, but it is preferable that the heat treatment is performed in a non-oxidizing atmosphere or a reducing atmosphere under a condition of 500° C. to 1050° C. The intermediate working step S04 and the intermediate heat treatment step S05 may be repeated.

(Finishing Step S06)

Next, the material which has undergone the above-described steps is optionally cut, and a surface thereof is optionally polished to remove an oxide film or the like formed on the surface. Cold working is performed at a predetermined working ratio. Temperature conditions in the finishing step S06 are not particularly limited but are preferably within a range of −200° C. to 200° C. In addition, a working ratio is appropriately selected so as to obtain a shape close to the final shape. In order to improve the strength through work hardening, the working ratio is preferably 30% or higher. In order to realize further improvement in the strength, the working ratio is preferably 50% or higher. A plastic working method is not particularly limited. However, when it is desired that the final shape is a sheet or a strip, rolling is preferably adopted. When it is desired that the final shape is a wire or a rod, extrusion or groove rolling is preferably adopted. When it is desired that the final shape is a bulk shape, forging or pressing is preferably adopted.

(Aging Heat Treatment Step S07)

Next, an aging heat treatment is performed on the finished material obtained in the finishing step S06 in order to improve the strength and the electrical conductivity. In the aging heat treatment step S07, fine Cu—Zr—Si particles having a particle size of 1 nm to 500 nm are precipitated.

Here, a heat treatment temperature is not particularly limited but is preferably within a range of 250° C. to 600° C. such that Cu—Zr—Si particles having the optimum size are uniformly dispersed and precipitated. Since the precipitation state can be recognized based on the electrical conductivity, it is preferable that heat treatment conditions (temperature, time) are appropriately set so as to obtain a predetermined electrical conductivity.

Here, the finishing step S06 and the aging heat treatment step S07 described above may be repeated. In addition, after the aging heat treatment step S07, cold working may be performed at a working ratio of 1% to 70% in order to correct the shape and to improve the strength. Further, a heat treatment may be performed in order to perform thermal refining or to remove residual strain. A cooling method after the heat treatment is not particularly limited, but a method such as water quenching in which the cooling rate is 200° C./min or higher is preferably adopted.

Through the above-describes steps, the copper alloy for electronic and electric devices having the Cu—Zr—Si particles is prepared. In the copper alloy for electric and electronic devices, the 0.2% yield strength is 300 MPa or higher, and the Vickers hardness is 100 HV or higher.

In addition, when rolling is used as the working method in the finishing step S06, a copper alloy sheet (strip) for electric and electronic devices having a thickness of about 0.05 mm to 1.0 mm can be obtained. This sheet can be used for a component for electric and electronic devices without any change. However, a single surface or both surfaces of the sheet may be plated with Sn or Ag to form a film having a thickness of about 0.1 μm to 10 μm, thereby obtaining a plated copper alloy strip.

Further, for example, a component for electric and electronic devices such as a terminal (for example, a connector), a relay, a lead frame, or a bus bar can be formed by punching or bending the copper alloy for electronic and electric devices (copper alloy sheet for electric and electronic devices) according to the embodiment as a raw material.

In the copper alloy for electronic and electric devices according to the embodiment having the above-described configuration, the Zr content is 0.01 mass % or higher and lower than 0.11 mass %, the Si content is 0.002 mass % or higher and lower than 0.03 mass %, and the ratio Zr/Si of the Zr content (mass %) to the Si content (mass %) is within a range of 2 to 30. Therefore, the above-described Cu—Zr—Si particles are formed and are dispersed in the matrix of copper. As a result, the yield strength can be improved while maintaining the electrical conductivity, or the electrical conductivity can be improved while maintaining the yield strength. In addition, the Vickers hardness can be improved.

Here, the copper alloy for electric and electronic devices according to the embodiment includes the fine Cu—Zr—Si particles having a particle size of 1 nm to 500 nm. Therefore, the yield strength can be improved while maintaining high electrical conductivity.

Alternatively, the electrical conductivity can be further improved while maintaining high yield strength. In addition, the Vickers hardness can be improved.

Further, the copper alloy for electric and electronic devices according to the embodiment includes the coarse Cu—Zr—Si particles having a particle size of 1 μm to 50 μm. Therefore, the shearing performance can be significantly improved by the coarse Cu—Zr—Si particles functioning as a fracture origin during shearing.

In addition, in the copper alloy for electric and electronic devices according to the embodiment, the electrical conductivity is 80% IACS or higher. Therefore, Zr and Si do not form a solid solution in the matrix of copper, and the Cu—Zr—Si particles are sufficiently dispersed in the matrix. As a result, the strength can be reliably improved. In addition, the copper alloy for electric and electronic devices according to the embodiment can be used as a material of a component for electric and electronic devices in which particularly high electrical conductivity is required.

Here, when the copper alloy for electric and electronic devices according to the embodiment further includes 0.005 mass % to 0.1 mass % in total of one element or two or more elements selected from the group consisting of Ag, Sn, Al, Ni, Zn, and Mg, the yield strength can be further improved by the above elements forming a solid solution in the matrix of copper. That is, the strength can be improved through solid solution strengthening.

In addition, when the copper alloy for electric and electronic devices according to the embodiment further includes 0.005 mass % to 0.1 mass % in total of one element or two or more elements selected from the group consisting of Ti, Co, and Cr, these elements are precipitated alone or as a compound. As a result, the yield strength can be further improved without a decrease in the electrical conductivity. That is, the strength can be improved through precipitation strengthening.

Further, when the copper alloy for electric and electronic devices according to the embodiment further includes 0.005 mass % to 0.1 mass % in total of one element or two or more elements selected from the group consisting of P, Ca, Te, and B, relatively coarse particles are formed by the crystallization and segregation of the above elements during melting and casting. As a result, the shearing performance can be significantly improved by the coarse particles functioning as a fracture origin during shearing.

Further, the copper alloy for electric and electronic devices according to the embodiment has mechanical characteristics in which the 0.2% yield strength is 300 MPa or higher. Therefore, the copper alloy for electric and electronic devices according to the embodiment is suitable for a component in which particularly high strength is required, for example, for a movable contact of an electromagnetic relay or a spring portion of a terminal.

The copper alloy sheet for electric and electronic devices according to the embodiment includes a rolled material of the above-described copper alloy for electric and electronic devices. Therefore, the copper alloy for electric and electronic devices according to the embodiment has superior stress relaxation resistance and can be suitably used for a connector, other terminals, a movable contact of an electromagnetic relay, a lead frame, or a bus bar. In addition, according to the intended use, a Sn plating film or an Ag plating film may be formed on the surface of the copper alloy.

The component for electric and electronic devices, the terminal, and the bus bar according to the embodiment includes the above-described copper alloy for electric and electronic devices according to the embodiment. Therefore, the dimensional accuracy is superior, and superior characteristics can be exhibited even when the size and thickness are reduced.

Hereinabove, the copper alloy for electronic and electric devices according to the embodiment of the present invention has been described. However, the present invention is not limited to the embodiment and can be modified in various ways within a scope not departing from the technical idea of the present invention.

For example, in the above-described embodiment, an example of the method of manufacturing the copper alloy for electronic and electric devices has been described. However, the manufacturing method is not limited to the embodiment, and may be appropriately selected from existing manufacturing methods.

EXAMPLES

Hereinafter, the results of an experiment which was performed in order to verify the effects of the present invention will be described.

A copper raw material formed of oxygen-free copper (ASTM F68-Class1) having a purity of 99.99 mass % or higher was prepared. This copper raw material was charged into a high-purity graphite crucible and was melted using high-frequency induction heating in an atmosphere furnace having an Ar gas atmosphere. The component composition in the obtained molten copper was adjusted as shown in Tables 1 and 2 by adding various additional elements. Next, the molten copper was poured into a water-cooling copper mold to prepare an ingot. The size of the ingot was thickness: about 20 mm, width: about 20 mm, and length: about 100 mm to 120 mm.

A heat treatment step was performed on the obtained ingot in which the ingot was heated in an Ar gas atmosphere for 4 hours under temperature conditions shown in Tables 3 and 4 for homogenization and solutionization. Next, water quenching was performed. The heat-treated ingot was cut, and a surface thereof was polished to remove an oxide film.

Next, hot rolling was performed at a working ratio and a temperature shown in Tables 3 and 4, water quenching was performed, and cold rolling as a finishing step was performed under conditions shown in Tables 3 and 4. As a result, a strip having a thickness of about 0.5 mm was prepared.

An aging heat treatment was performed on the obtained strip at a temperature shown in Tables 3 and 4 until the electrical conductivity shown in Tables 5 and 6 was obtained. As a result, a strip for evaluating characteristics thereof was prepared.

(Evaluation of Workability)

In order to evaluate workability, whether or not edge cracking (cold rolling cracking) occurred during the above-described finishing step (during cold rolling) was observed. A strip where edge cracking did not occur in all the regions or substantially all the regions was evaluated as "A", a strip where a small edge crack having a length of less than 1 mm was formed was evaluated as "B", a strip where an edge crack having a length of 1 mm or more and less than 3 mm was formed was evaluated as "C", and a strip where a large edge crack having a length of more than 3 mm was formed was evaluated as "D". It was determined that "C" in which the length of the edge crack was 1 mm or more and less than 3 mm had no problems in practice.

The length of the edge crack refers to the length of an edge crack formed from an end to the center of the rolled material in a width direction thereof. The evaluation results are shown in Tables 5 and 6.

(Particle Observation)

In order to verify Cu—Zr—Si particles containing Cu, Zr, and Si, particles were observed using a transmission electron microscope (TEM: JEM-2010F, manufactured by JEOL Ltd.) and were analyzed by energy dispersive X-ray spectroscopy (EDX).

Figure 2:
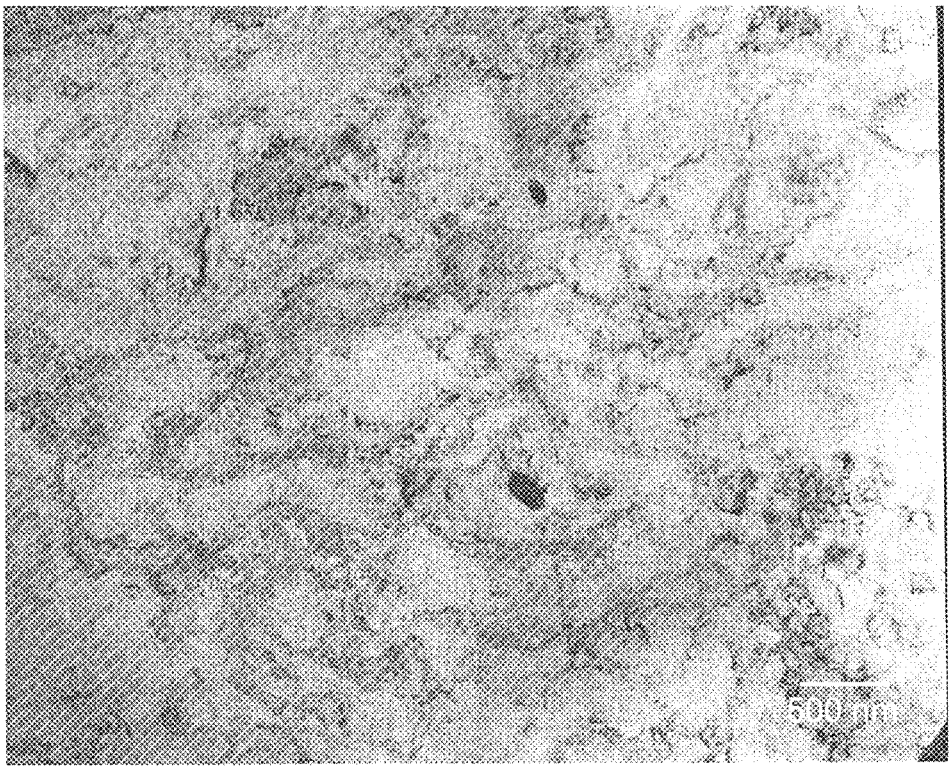
FIG. 2 is a structural image of a portion containing a precipitate in an alloy according to Example No. 5 when observed with a transmission electron microscope (TEM) at a magnification of 20,000 times.
Figure 3A:
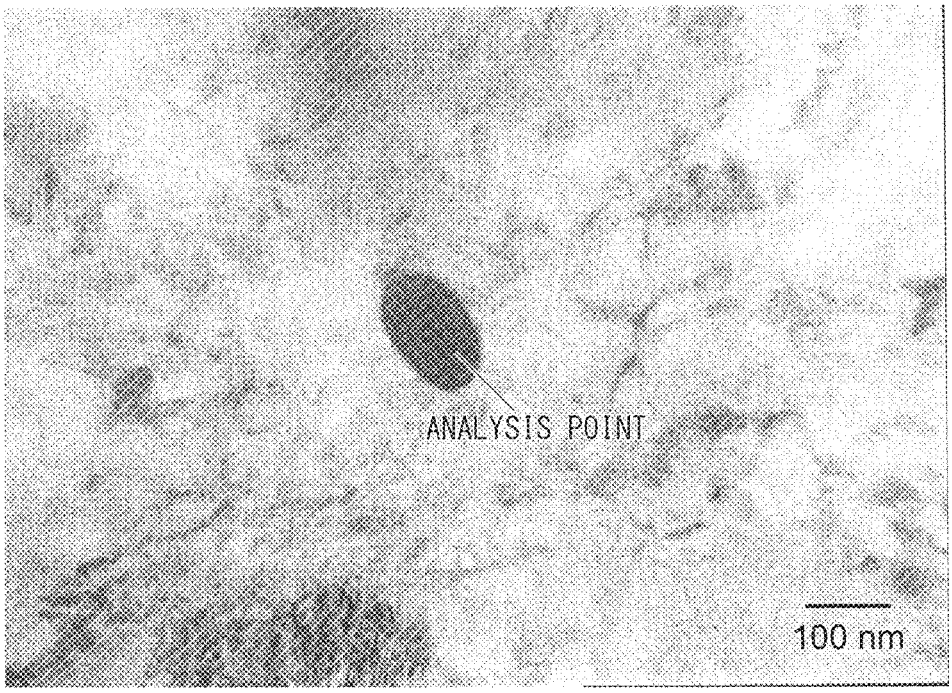
FIG. 3A is a structural image of the portion containing a precipitate in the alloy according to Example No. 5 when observed with a transmission electron microscope (TEM) at a magnification of 100,000 times.

First, as shown in FIG. 2, the particles were observed using a TEM at 20,000 times (observation visual field: $2\times10^7$ $nm^2$). As shown in FIG. 3A, the observed particles were observed at 100,000 times (observation visual field: $7\times10^5$ $nm^2$). In addition, particles having a particle size of less than 10 nm were observed at 500,000 times (observation visual field: $3\times10^4$ $nm^2$).

Figure 3B:
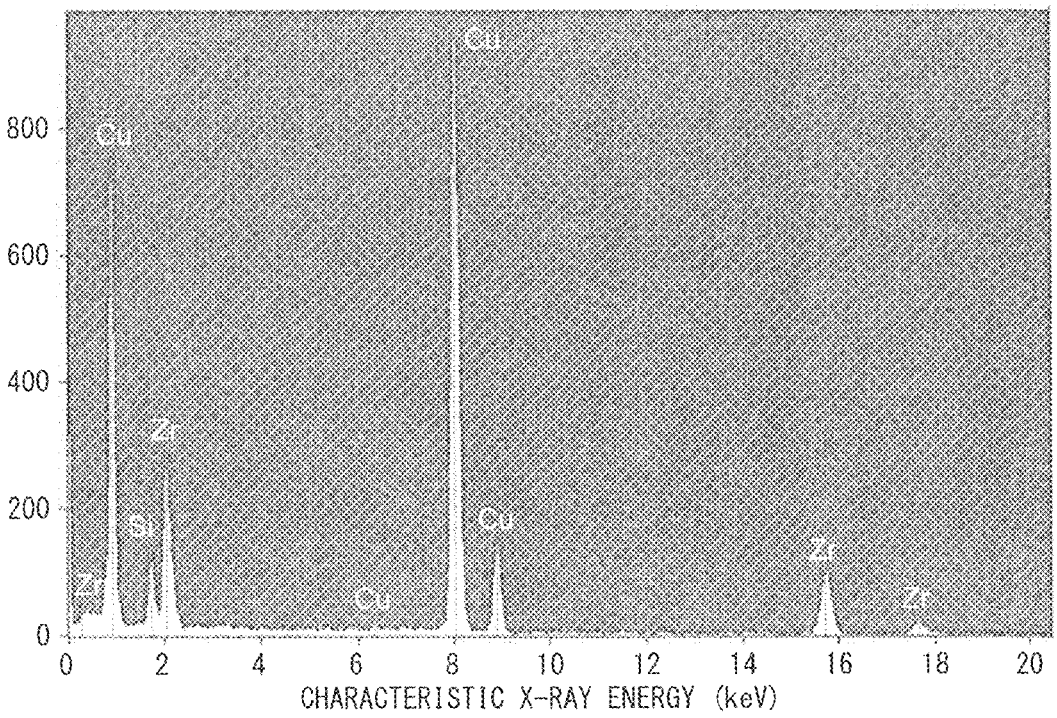
FIG. 3B is a graph showing the results of analyzing particles observed in FIG. 3A with energy dispersive X-ray spectroscopy (EDX).

In addition, the composition of the observed particles was analyzed by energy dispersive X-ray spectroscopy (EDX), and it was verified that these particles were Cu—Zr—Si particles. An example of the EDX analysis results is shown in FIG. 3B.

As the particle size of the Cu—Zr—Si particles, an average value of a long diameter (the length of the longest line in a particle in non-contact with a grain boundary) and a short diameter (the length of the longest line in a direction perpendicular to the long diameter in non-contact with a grain boundary) was set.

A case where the Cu—Zr—Si particles having a particle size of 1 nm to 500 nm were observed by the structure observation was evaluated as A, and a case where the Cu—Zr—Si particles having a particle size of 1 nm to 500 nm were not observed by the structure observation was evaluated as D. The evaluation results are shown in Tables 5 and 6.

(Electrical Conductivity)

A specimen having a width of 10 mm and a length of 60 mm was collected from the strip for evaluating characteristics thereof, and the electrical resistance thereof was obtained using a four-terminal method. In addition, the dimensions of the specimen were measured using a micrometer to calculate the volume of the specimen. The electrical conductivity was calculated based on the measured electrical resistance value and the volume. The specimen was collected from the strip for evaluating characteristics thereof using a method in which a longitudinal direction of the specimen was perpendicular to a rolling direction of the strip for evaluating characteristics thereof. The measurement results are shown in Tables 5 and 6.

(Mechanical Characteristics)

13B specimen defined in JIS Z 2241 (ISO 6892-1: 2009, Metallic materials-Tensile testing-Part 1: Method of test at room temperature (MOD)) was collected from the strip for evaluating characteristics thereof, and the 0.2% yield strength and tensile strength thereof were measured using an offset method. The specimen was collected from the strip for evaluating characteristics thereof using a method in which a tensile direction of the tensile test was perpendicular to a rolling direction of the strip for evaluating characteristics thereof.

In addition, the Young's modulus E was obtained by attaching a strain gauge to the above-described specimen to obtain a gradient of a load-elongation curve. The evaluation results are shown in Tables 5 and 6.

(Vickers Hardness)

The Vickers hardness was measured at a test load of 0.98 N in a micro-Vickers hardness test method defined in JIS Z 2244 (ISO 6507-4). The evaluation results are shown in Tables 5 and 6.

TABLE 1

| | | Component Composition (mass %) | | | | | | |
|---|---|---|---|---|---|---|---|---|
| | | Zr | Si | Zr/Si | Other Elements | | | Cu |
| Example | 1 | 0.107 | 0.023 | 4.7 | — | | | Balance |
| | 2 | 0.107 | 0.023 | 4.7 | — | | | Balance |
| | 3 | 0.073 | 0.021 | 3.5 | — | | | Balance |
| | 4 | 0.073 | 0.021 | 3.5 | — | | | Balance |
| | 5 | 0.051 | 0.022 | 2.3 | — | | | Balance |
| | 6 | 0.051 | 0.022 | 2.3 | — | | | Balance |
| | 7 | 0.097 | 0.016 | 6.1 | — | | | Balance |
| | 8 | 0.097 | 0.016 | 6.1 | — | | | Balance |
| | 9 | 0.057 | 0.009 | 6.3 | — | | | Balance |
| | 10 | 0.057 | 0.009 | 6.3 | — | | | Balance |
| | 11 | 0.018 | 0.009 | 2.0 | — | | | Balance |
| | 12 | 0.018 | 0.009 | 2.0 | — | | | Balance |
| | 13 | 0.085 | 0.003 | 28.3 | — | | | Balance |
| | 14 | 0.085 | 0.003 | 28.3 | — | | | Balance |
| | 15 | 0.050 | 0.003 | 16.7 | — | | | Balance |
| | 16 | 0.050 | 0.003 | 16.7 | — | | | Balance |
| | 17 | 0.034 | 0.004 | 8.5 | — | | | Balance |
| | 18 | 0.034 | 0.004 | 8.5 | — | | | Balance |
| | 19 | 0.069 | 0.023 | 3.0 | Ag: 0.034 | Zn: 0.036 | | Balance |
| | 20 | 0.071 | 0.023 | 3.1 | Ag: 0.030 | Zn: 0.025 | Co: 0.01 | Balance |
| | 21 | 0.086 | 0.029 | 3.0 | Sn: 0.039 | | | Balance |
| | 22 | 0.083 | 0.028 | 3.0 | Sn: 0.042 | B: 0.005 | | Balance |

TABLE 1-continued

| | Component Composition (mass %) | | | | | |
|---|---|---|---|---|---|---|
| | Zr | Si | Zr/Si | Other Elements | | Cu |
| 23 | 0.073 | 0.020 | 3.7 | Al: 0.006 | | Balance |
| 24 | 0.071 | 0.019 | 3.7 | Al: 0.008 | Ti: 0.008 | Balance |

TABLE 2

| | | Component Composition (mass %) | | | | | |
|---|---|---|---|---|---|---|---|
| | | Zr | Si | Zr/Si | Other Elements | | Cu |
| Example | 25 | 0.073 | 0.021 | 3.5 | Ni: 0.043 | | Balance |
| | 26 | 0.075 | 0.020 | 3.8 | Ni: 0.022 | Cr: 0.02 | Balance |
| | 27 | 0.063 | 0.022 | 2.9 | Mg: 0.046 | | Balance |
| | 28 | 0.066 | 0.024 | 2.8 | Mg: 0.040 | Te: 0.007 | Balance |
| | 29 | 0.059 | 0.021 | 2.8 | Sn: 0.065 | Mg: 0.027 | Balance |
| | 30 | 0.059 | 0.024 | 2.5 | Sn: 0.048 | Mg: 0.011 Co: 0.008 | Balance |
| | 31 | 0.053 | 0.025 | 2.1 | Ti: 0.008 | | Balance |
| | 32 | 0.050 | 0.021 | 2.4 | Ti: 0.006 | Ca: 0.005 | Balance |

TABLE 2-continued

| | | Component Composition (mass %) | | | | | |
|---|---|---|---|---|---|---|---|
| | | Zr | Si | Zr/Si | Other Elements | | Cu |
| | 33 | 0.074 | 0.020 | 3.7 | Co: 0.028 | | Balance |
| | 34 | 0.072 | 0.021 | 3.4 | Co: 0.020 | Mg: 0.017 Te: 0.005 | Balance |
| | 35 | 0.096 | 0.010 | 9.6 | Cr: 0.075 | | Balance |
| | 36 | 0.092 | 0.009 | 10.2 | Cr: 0.060 | Zn: 0.007 Ca: 0.010 | Balance |
| | 37 | 0.076 | 0.019 | 4.0 | P: 0.006 | | Balance |
| | 38 | 0.078 | 0.021 | 3.7 | P: 0.006 | Al: 0.007 | Balance |
| | 39 | 0.065 | 0.015 | 4.3 | Ca: 0.006 | | Balance |
| | 40 | 0.064 | 0.015 | 4.3 | Ca: 0.006 | Ag: 0.010 | Balance |
| | 41 | 0.070 | 0.016 | 4.4 | Te: 0.015 | | Balance |
| | 42 | 0.072 | 0.018 | 4.0 | Te: 0.010 | Zn: 0.007 | Balance |
| | 43 | 0.091 | 0.012 | 7.6 | B: 0.005 | | Balance |
| | 44 | 0.093 | 0.012 | 7.8 | B: 0.007 | Al: 0.010 | Balance |
| Comparative Example | 1 | 0.187 | 0.007 | 26.7 | — | | Balance |
| | 2 | 0.003 | 0.001 | 3.0 | — | | Balance |
| | 3 | 0.055 | 0.041 | 1.3 | — | | Balance |

TABLE 3

| | | Heat Treatment | Hot Working Step | | | Finishing Step | Aging Heat |
|---|---|---|---|---|---|---|---|
| | | Step Temperature ° C. | Rolling Reduction % | Start Temperature ° C. | End Temperature ° C. | Rolling Reduction % | Treatment Step Temperature ° C. |
| Example | 1 | 960 | 60 | 900 | 700 | 94 | 400 |
| | 2 | 960 | 60 | 900 | 700 | 94 | 450 |
| | 3 | 960 | 60 | 900 | 700 | 94 | 400 |
| | 4 | 960 | 60 | 900 | 700 | 94 | 450 |
| | 5 | 960 | 60 | 900 | 700 | 94 | 400 |
| | 6 | 960 | 60 | 900 | 700 | 94 | 450 |
| | 7 | 960 | 60 | 900 | 700 | 94 | 400 |
| | 8 | 960 | 60 | 900 | 700 | 94 | 450 |
| | 9 | 960 | 60 | 900 | 700 | 94 | 400 |
| | 10 | 960 | 60 | 900 | 700 | 94 | 450 |
| | 11 | 960 | 60 | 900 | 700 | 94 | 400 |
| | 12 | 960 | 60 | 900 | 700 | 94 | 450 |
| | 13 | 960 | 60 | 900 | 700 | 94 | 400 |
| | 14 | 960 | 60 | 900 | 700 | 94 | 450 |
| | 15 | 960 | 60 | 900 | 700 | 94 | 400 |
| | 16 | 960 | 60 | 900 | 700 | 94 | 450 |
| | 17 | 960 | 60 | 900 | 700 | 94 | 400 |
| | 18 | 960 | 60 | 900 | 700 | 94 | 450 |
| | 19 | 960 | 60 | 900 | 700 | 94 | 400 |
| | 20 | 960 | 60 | 900 | 700 | 94 | 450 |
| | 21 | 960 | 60 | 900 | 700 | 94 | 400 |
| | 22 | 960 | 60 | 900 | 700 | 94 | 450 |
| | 23 | 960 | 60 | 900 | 700 | 94 | 400 |
| | 24 | 960 | 60 | 900 | 700 | 94 | 450 |

TABLE 4

| | | Heat Treatment | Hot Working Step | | | Finishing Step | Aging Heat Treatment |
|---|---|---|---|---|---|---|---|
| | | Step Temperature ° C. | Rolling Reduction % | Start Temperature ° C. | End Temperature ° C. | Rolling Reduction % | Step Temperature ° C. |
| Example | 25 | 960 | 60 | 900 | 700 | 94 | 400 |
| | 26 | 960 | 60 | 900 | 700 | 94 | 450 |
| | 27 | 960 | 60 | 900 | 700 | 94 | 400 |
| | 28 | 960 | 60 | 900 | 700 | 94 | 450 |
| | 29 | 960 | 60 | 900 | 700 | 94 | 400 |

TABLE 4-continued

| | | Heat Treatment | Hot Working Step | | | Finishing Step | Aging Heat Treatment |
|---|---|---|---|---|---|---|---|
| | | Step Temperature ° C. | Rolling Reduction % | Start Temperature ° C. | End Temperature ° C. | Rolling Reduction % | Step Temperature ° C. |
| | 30 | 960 | 60 | 900 | 700 | 94 | 450 |
| | 31 | 960 | 60 | 900 | 700 | 94 | 400 |
| | 32 | 960 | 60 | 900 | 700 | 94 | 450 |
| | 33 | 960 | 60 | 900 | 700 | 94 | 400 |
| | 34 | 960 | 60 | 900 | 700 | 94 | 450 |
| | 35 | 960 | 60 | 900 | 700 | 94 | 400 |
| | 36 | 960 | 60 | 900 | 700 | 94 | 450 |
| | 37 | 960 | 60 | 900 | 700 | 94 | 400 |
| | 38 | 960 | 60 | 900 | 700 | 94 | 450 |
| | 39 | 960 | 60 | 900 | 700 | 94 | 400 |
| | 40 | 960 | 60 | 900 | 700 | 94 | 450 |
| | 41 | 960 | 60 | 900 | 700 | 94 | 400 |
| | 42 | 960 | 60 | 900 | 700 | 94 | 450 |
| | 43 | 960 | 60 | 900 | 700 | 94 | 400 |
| | 44 | 960 | 60 | 900 | 700 | 94 | 450 |
| Comparative Example | 1 | 960 | 60 | 900 | 700 | 94 | — |
| | 2 | 960 | 60 | 900 | 700 | 94 | 350 |
| | 3 | 960 | 60 | 900 | 700 | 94 | 400 |

TABLE 5

| | | Cold Rolling Cracking | Cu—Zr—Si Particles having Size of 1 nm to 500 nm | Electrical Conductivity % IACS | 0.2% Yield Strength MPa | Vickers Hardness HV |
|---|---|---|---|---|---|---|
| Example | 1 | C | A | 82.9 | 525 | 177 |
| | 2 | C | A | 84.5 | 500 | 173 |
| | 3 | A | A | 85.8 | 479 | 162 |
| | 4 | A | A | 89.2 | 446 | 155 |
| | 5 | A | A | 87.6 | 456 | 153 |
| | 6 | A | A | 91.4 | 420 | 145 |
| | 7 | C | A | 83.9 | 514 | 173 |
| | 8 | C | A | 85.1 | 498 | 174 |
| | 9 | A | A | 89.8 | 446 | 149 |
| | 10 | A | A | 93.8 | 405 | 140 |
| | 11 | A | A | 91.3 | 425 | 143 |
| | 12 | A | A | 92.9 | 400 | 138 |
| | 13 | A | A | 88.6 | 481 | 161 |
| | 14 | A | A | 90.0 | 448 | 154 |
| | 15 | A | A | 91.0 | 444 | 148 |
| | 16 | A | A | 92.5 | 425 | 147 |
| | 17 | A | A | 91.3 | 437 | 146 |
| | 18 | A | A | 94.3 | 311 | 102 |
| | 19 | A | A | 84.1 | 500 | 168 |
| | 20 | A | A | 87.3 | 465 | 160 |
| | 21 | B | A | 86.8 | 503 | 170 |
| | 22 | B | A | 91.1 | 475 | 162 |
| | 23 | A | A | 85.2 | 479 | 162 |
| | 24 | A | A | 87.9 | 460 | 159 |

TABLE 6

| | | Cold Rolling Cracking | Cu—Zr—Si Particles having Size of 1 nm to 500 nm | Electrical Conductivity % IACS | 0.2% Yield Strength MPa | Vickers Hardness HV |
|---|---|---|---|---|---|---|
| Example | 25 | A | A | 83.9 | 489 | 165 |
| | 26 | A | A | 87.3 | 461 | 160 |
| | 27 | A | A | 86.3 | 481 | 162 |
| | 28 | A | A | 89.5 | 450 | 157 |
| | 29 | A | A | 86.3 | 493 | 165 |
| | 30 | A | A | 90.3 | 473 | 164 |
| | 31 | A | A | 86.6 | 482 | 162 |
| | 32 | A | A | 90.2 | 455 | 158 |
| | 33 | A | A | 84.3 | 495 | 165 |
| | 34 | A | A | 87.7 | 458 | 158 |
| | 35 | C | A | 81.5 | 526 | 179 |
| | 36 | C | A | 84.0 | 504 | 174 |

TABLE 6-continued

| | | Cold Rolling Cracking | Cu—Zr—Si Particles having Size of 1 nm to 500 nm | Electrical Conductivity % IACS | 0.2% Yield Strength MPa | Vickers Hardness HV |
|---|---|---|---|---|---|---|
| | 37 | B | A | 90.0 | 470 | 157 |
| | 38 | B | A | 92.1 | 448 | 155 |
| | 39 | C | A | 88.8 | 469 | 157 |
| | 40 | C | A | 92.3 | 440 | 153 |
| | 41 | C | A | 87.2 | 472 | 157 |
| | 42 | C | A | 90.0 | 442 | 152 |
| | 43 | C | A | 89.8 | 465 | 157 |
| | 44 | C | A | 93.0 | 432 | 150 |
| Comparative | 1 | D | — | — | — | — |
| Example | 2 | A | D | 97.5 | 218 | 96 |
| | 3 | A | A | 75.6 | 475 | 153 |

In Comparative Example 1 in which the Zr content is higher the range of the present invention, a large edge crack was formed during finishing (cold rolling). Therefore, the subsequent step was not evaluated.

In Comparative Example 2 in which the Zr content is lower than the range of the present invention, the Cu—Zr—Si particles having a particle size of 1 nm to 500 nm were not observed, the 0.2% yield strength was lower than 218 MPa, and the Vickers hardness was insufficient. Here, the reason why the electrical conductivity was high in Comparative Example 2 although the Cu—Zr—Si particles were not present is as follows. Since the addition amounts of Zr and Si were excessively small, Zr and Si were not precipitated, and the amount of a solid solution in copper is small.

In Comparative Example 3 in which the ratio Zr/Si of the Zr content (mass %) to the Si content (mass %) is lower than the range of the present invention, the electrical conductivity significantly decreased. Here, the reason why the electrical conductivity was low in Comparative Example 3 although the Cu—Zr—Si particles were present is as follows. Although the Cu—Zr—Si particles were precipitated, an excess amount of Si was added and thus formed a solid solution in copper.

On the other hand, in Examples 1 to 44, a large edge crack having a length of 3 mm or more was not formed during finishing (cold rolling). In addition, in all of the Examples 1 to 44, the Cu—Zr—Si particles having a particle size of 1 nm to 500 nm were observed, and the electrical conductivity and the yield strength were high. Further, the Vickers hardness was high.

It was verified from the above results that, according to Examples, a copper alloy for electric and electronic devices can be provided which has high electrical conductivity, high yield strength, and high Vickers hardness and is suitable for a component for electric and electronic devices.

The invention claimed is:

1. A copper alloy sheet for electric and electronic devices, wherein a composition of the copper alloy sheet consists of:

0.01 mass % or higher and lower than 0.11 mass % of Zr;

0.002 mass % or higher and lower than 0.03 mass % of Si; and a balance including Cu and unavoidable impurities, a ratio Zr/Si of a mass % of Zr to a mass % of Si is within a range of 2 to 30, Cu—Zr—Si particles are dispersed in a matrix of copper, at least a part of the Cu—Zr—Si particles have a particle size of 1 nm to 500 nm, and the copper alloy sheet has a surface Vickers hardness of 153 HV or higher.

2. The copper alloy sheet for electric and electronic devices according to claim 1, wherein electrical conductivity is 80% IACS or higher.

3. The copper alloy sheet for electric and electronic devices according to claim 1, wherein 0.2% yield strength is 300 MPa or higher.

4. The copper alloy sheet for electric and electronic devices according to claim 1, wherein the copper alloy sheet is a rolled material with a thickness in a range of 0.05 mm to 1.0 mm.

5. The copper alloy sheet for electric and electronic devices according to claim 1, wherein a surface is plated with Sn or Ag.

6. A component for electric and electronic devices, the component comprising:

the copper alloy sheet for electric and electronic devices according to claim 1.

7. A terminal comprising:

the copper alloy sheet for electric and electronic devices according to claim 1.

8. A bus bar comprising:

the copper alloy sheet for electric and electronic devices according to claim 1.

9. The copper alloy sheet for electric and electronic devices according to claim 1, wherein the copper alloy is produced from an ingot made of a molten copper alloy, and the ingot undergoes a heat treatment step where the ingot is heated at 960° C. to 1080° C. for four hours for solutionization.

10. The copper alloy sheet for electric and electronic devices according to claim 9, wherein immediately after the heat treatment step, the copper alloy undergoes a hot working step for homogenization where the copper alloy is worked to form a final shaper at 500° C. to 1050° C.

* * * * *